US008079222B2

(12) United States Patent
Shih

(10) Patent No.: US 8,079,222 B2
(45) Date of Patent: Dec. 20, 2011

(54) THERMOELECTRIC COOLER CONTROLLER

(75) Inventor: Yu-Yun Shih, Fremont, CA (US)

(73) Assignee: Applied Optoelectronics, Inc., Sugar Land, TX (US)

( * ) Notice: Subject to any disclaimer, the term of this patent is extended or adjusted under 35 U.S.C. 154(b) by 782 days.

(21) Appl. No.: 12/024,041

(22) Filed: Jan. 31, 2008

(65) Prior Publication Data

US 2009/0195980 A1 Aug. 6, 2009

(51) Int. Cl.
*F25B 21/02* (2006.01)

(52) U.S. Cl. ..... 62/3.7; 62/259.2

(58) Field of Classification Search ..... 62/3.2, 62/3.7, 259.2
See application file for complete search history.

(56) References Cited

U.S. PATENT DOCUMENTS 5,483,800 A * 1/1996 Schrage ..... 62/3.7
6,098,408 A * 8/2000 Levinson et al. ..... 62/3.2
6,205,790 B1 * 3/2001 Denkin et al. ..... 62/3.7
6,584,128 B2 * 6/2003 Kroeger ..... 372/34

OTHER PUBLICATIONS

Transceivers, Applied Optoelectronics, Inc., http://www.ao-inc.com/products/transceivers-SFP.php, 2000-2005, 3 pages.
HFBR-0534 Evaluation Kit, Product Brief, Avago Technologies, http://www.avagotech.com/assets/downloadDocument.do?id=2124, Feb. 23, 2007, 3 pages.
"Agilent HFBR-57M5AP Digital Diagnostic Small Form Pluggable Transceiver for Fibre Channel 2.125, 1.0625GBd and .25 GBd Ethernet" Data Sheet, Agilent Technologies, http://literature.agilent.com/litweb/pdf/5988-8406EN.pdf, Aug. 18, 2003, 19 pages.
"DWDM SFP Daughter Board" Document No. A500-1002, May 3, 2007, 1 page.
MIC2202, "High Efficiency 2MHz Synchronous Buck Converter 1μF Stable PWM Regulator" Micrel, Inc., May 2004, 18 pages.
"Smallest TEC Power Drivers for Optical Modules" Maxim Integrated Products, Inc., 2002, 19 pages.

* cited by examiner

*Primary Examiner* — Melvin Jones
(74) *Attorney, Agent, or Firm* — Norman A. Kinsella; Berkeley Law & Technology Group, LLP

(57) ABSTRACT

The subject matter disclosed herein relates to a method and/or system for adjusting a thermoelectric cooler.

20 Claims, 5 Drawing Sheets

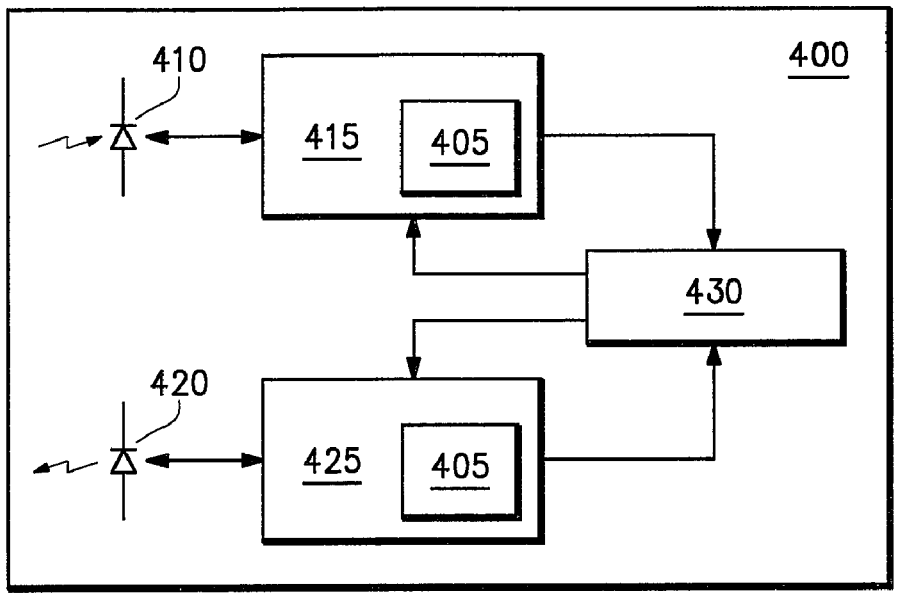
FIG.4
FIG.5A
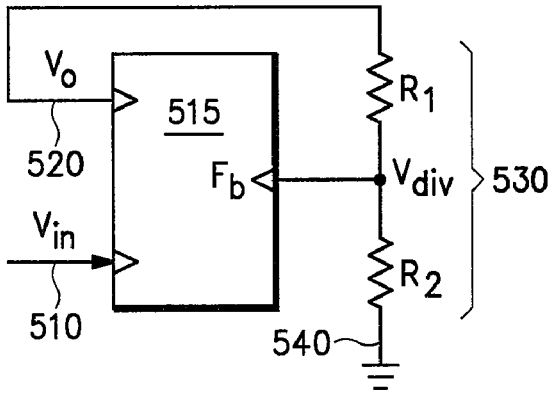
FIG.5B
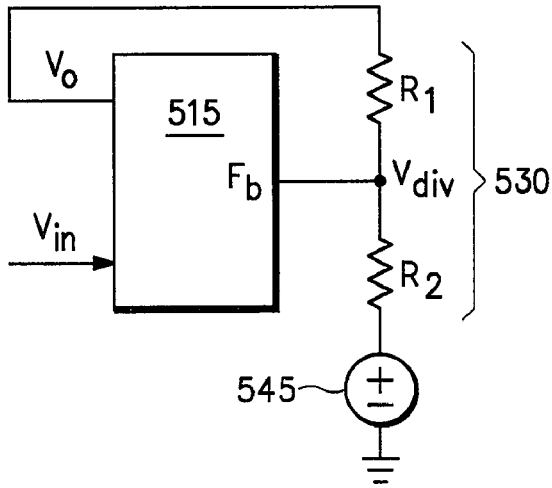

THERMOELECTRIC COOLER CONTROLLER

FIELD

Subject matter disclosed herein relates to a circuit to adjust or modify a thermoelectric cooler.

BACKGROUND

A Thermo-Electric Cooler (TEC) may be found in many applications that employ precision temperature adjustment, including optical transceivers, for example. The small size of the TEC may allow thermal adjustment of individual components, such as fiber optic laser diodes, precision voltage references, or any other temperature-sensitive device. Temperature-sensitive components may be integrated with a TEC and a temperature monitor into a single thermally-engineered module, in some situations.

Unfortunately, a TEC tends to have low efficiency or uses relatively high power, typically operating at high current.

Industry consensus has resulted in optical transceiver modules that meet common electrical, management, and mechanical specifications. Such a module is commonly referred to as a small form-factor pluggable (SFP) module. One newer high-speed variant is commonly referred to as an XFP module.

Proposal SFF-8472, Rev 10.3, released Dec. 1, 2007 (available at ftp://ftp.seagate.com/sff), for example, describes an enhanced functions monitoring interface for optical transceivers, which allows real time access to an SFP/XFP module to monitor its temperature, among other parameters. Performance or stability of optical receivers may relate, at least in part, to temperature, so monitoring or an ability to adjust temperature may be beneficial. Moreover, recent industry specifications, such as those briefly described above, may call for monitoring or adjusting temperature efficiently within the confines of a transceiver module.

BRIEF DESCRIPTION OF THE FIGURES

Non-limiting and non-exhaustive embodiments will be described with reference to the following figures, wherein like reference numerals refer to like parts throughout the various figures unless otherwise specified.

FIG. 4 is a schematic showing a sample configuration of a transceiver including a microcontroller, according to an embodiment.

FIG. 5A is a schematic diagram of a sample voltage converter, according to an embodiment.

FIG. 5B is a schematic diagram of a sample voltage converter, according to another embodiment.

DETAILED DESCRIPTION

Figure 1:
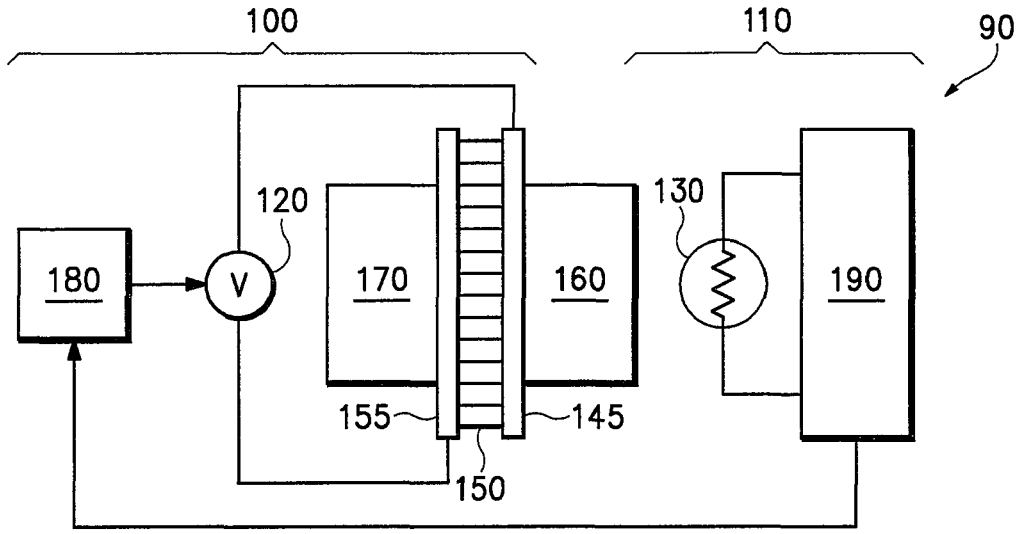
FIG. 1 is a circuit diagram showing a particular configuration of a thermoelectric cooler (TEC) circuit and a thermistor circuit.

Reference throughout this specification to "one embodiment" or "an embodiment" means that a particular feature, structure, or characteristic described in connection with an embodiment is included in at least one embodiment of claimed subject matter. Thus, appearances of the phrase "in one embodiment" or "an embodiment" in various places throughout this specification are not necessarily all referring to the same embodiment. Furthermore, particular features, structures, or characteristics may be combined in one or more embodiments.

A thermoelectric cooler (TEC) may be used to adjust or substantially maintain temperatures of transceiver components, such as a laser diode or avalanche photodiode (APD), for example. A laser diode emission wavelength and APD gain may both be related to temperature, so an ability to adjust transceiver temperature may be desired.

In an embodiment, a TEC may be placed in thermal contact to adjust a component's temperature. A thermistor or other temperature sensor may also be placed in thermal contact to detect the component's temperature. For temperature adjustment, a temperature sensor may send temperature information to a controller, such as a microcontroller or microprocessor, for example, where the temperature information may be compared with a reference temperature, generating an error signal, or TEC offset. A TEC offset may be generated, for example, by averaging a number of temperature measurements made over a period of time. Of course, a host of different approaches to estimating TEC offset are possible and claimed subject matter is not limited in scope to any particular method or approach. A TEC offset may also be used by the microcontroller to produce a TEC drive current to vary the amount of heating or cooling by the TEC as appropriate to adjust or substantially maintain a component temperature.

An amount of heating or cooling performed by a TEC may relate to current, and may, as an idealized example provided merely to aid comprehension, relate approximately linearly to the current. However, claimed subject matter is not limited in scope to this idealized model. Again, this is intended as an example simply for the purpose of aiding comprehension. Nonetheless, at relatively small drive currents, a useful relationship to TEC behavior may not hold. Relatively small TEC drive currents may occur if, for example, a TEC is heating or cooling by a relatively small amount. For example, if a TEC is switched from a heater to a cooler its drive current may cross through zero as it switches polarity. Since very little, if any, performance benefit may be gained while a TEC is operated at low drive currents, it may be advantageous to have TEC operating voltage be as low as possible to reduce power loss. In other words, if a TEC is operating at relatively low drive current, power loss in a TEC may relate to operating voltage, which, accordingly, should be reduced.

By adjusting TEC drive current or operating voltage, a microcontroller may adjust an amount of power that may be delivered to a TEC to adjust a component temperature. Though a microcontroller is mentioned in the Specification as an example, a processor, such as a microprocessor, or any device that can carry out mathematical or logical operations, for example, and perhaps include a memory, may be used. As a TEC results in heating or cooling a component, measured component temperature may be monitored. The microcontroller, or similar device, may perform operations, as will be explained in detail below, to adjust TEC drive current or operating voltage so that the TEC approximately attains or maintains a desired component temperature. For example, a difference between a desired component temperature and a measured component temperature may result in a TEC offset calculated by a microcontroller. Such a TEC offset may be considered if performing adjustments to TEC drive current or operating voltage.

A microcontroller may be used in a process to adjust TEC operating voltage while considering component temperature. In an embodiment, a microcontroller may be used in a process of driving TEC operating voltage to about zero volts, thus reducing power delivered to the TEC at low TEC drive currents. While performing this process, the microcontroller may consider a computed TEC offset, as will be explained below.

In an embodiment, a microcontroller may operate a plurality of voltage converters to generate a TEC drive current. Of course, claimed subject matter is not limited in scope to employing voltage converters. This is merely one example embodiment. However, a voltage converter generally converts a first voltage level to a second voltage level. A DC-DC converter is an example of a voltage converter. At least one of the voltage converters may have an output voltage capable of being driven to about zero volts. The voltage converters may be comprised of field effect transistors (FET's). The FET's may have a relatively low turn-on, or threshold voltage Vth. Such an FET may provide a high-efficiency voltage converter, though such high efficiency is not necessary. Thus, embodiments are possible that may not employ a FET that provides such efficiency.

For an example of a temperature-adjusting apparatus, FIG. 1 is a schematic showing a configuration 90 of a TEC circuit embodiment 100 combined with a thermistor circuit embodiment 110. A TEC 150 may include a side 145 in thermal contact with a temperature-adjusting component 160 and another side 155 being in contact with a heat sink/source 170, for example. However, this configuration is only an example, and any side of a TEC may be in contact with a component, such as 160, which may be cooled or heated. Here, however, power supply 120 may generate electrical current or voltage sufficient to appropriately heat or cool side 145 relative to side 155, or vise versa. Power supply 120 may be adjusted by a microcontroller 180. A temperature of component 160 may be measured by a thermistor 130 that is in thermal contact with the component. Thermistor 130 may generate a voltage at its terminals, which may be connected or coupled to sensor circuitry 190 to generate a measurement signal that may be fed to microcontroller 180. Completing a feedback control loop, microcontroller 180 may then adjust the power delivered by power supply 120 to modify TEC temperature as desired.

Figure 2:
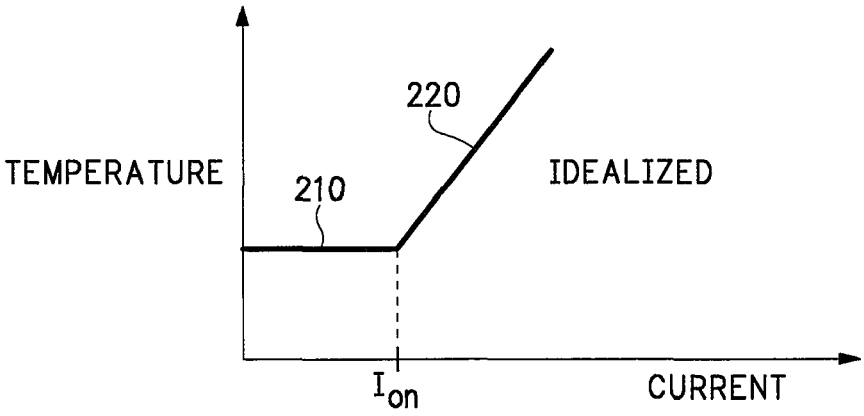
FIG. 2 is a graph showing a relationship between temperature and drive current for a particular TEC.

FIG. 2 is a model graph showing a relationship between temperature and drive current for a particular idealized TEC. It is noted, again, that this example is provided merely for purposes of explanation and that claimed subject matter is not limited in scope to a TEC, for example, having this particular relationship. Satisfactory performance from embodiments within the scope of claimed subject matter will be realized in situations where this relationship may not apply. However, continuing with this example, the X-axis indicates drive current and the Y-axis indicates temperature of a hot side of the TEC. As indicated in the theoretical plot in FIG. 2, below a turn-on drive current $I_{on}$, temperature may be relatively constant for varying drive current, as indicated in regime 210. Above drive current $I_{on}$, temperature may change with drive current, as indicated in regime 220. As this TEC behavior indicates, a TEC operates with relative low efficiency in regime 210 since increasing current does not produce a relative increase in the TEC temperature. In other words, though a TEC maybe consuming power in regime 210, it is not producing a corresponding temperature increase on a relative basis. For a given TEC drive current less than $I_{on}$, reducing TEC operating voltage may reduce TEC power consumption. Thus, in some embodiments, one may increase efficiency of a TEC by reducing TEC operating voltage to almost zero if the TEC is operating at a relatively low-current, such as, for example, during a transient phase if the TEC switches polarity to heat instead of cool a device, or vise versa. Of course, this is merely one example, and claimed subject matter is not limited in this respect.

Figure 3:
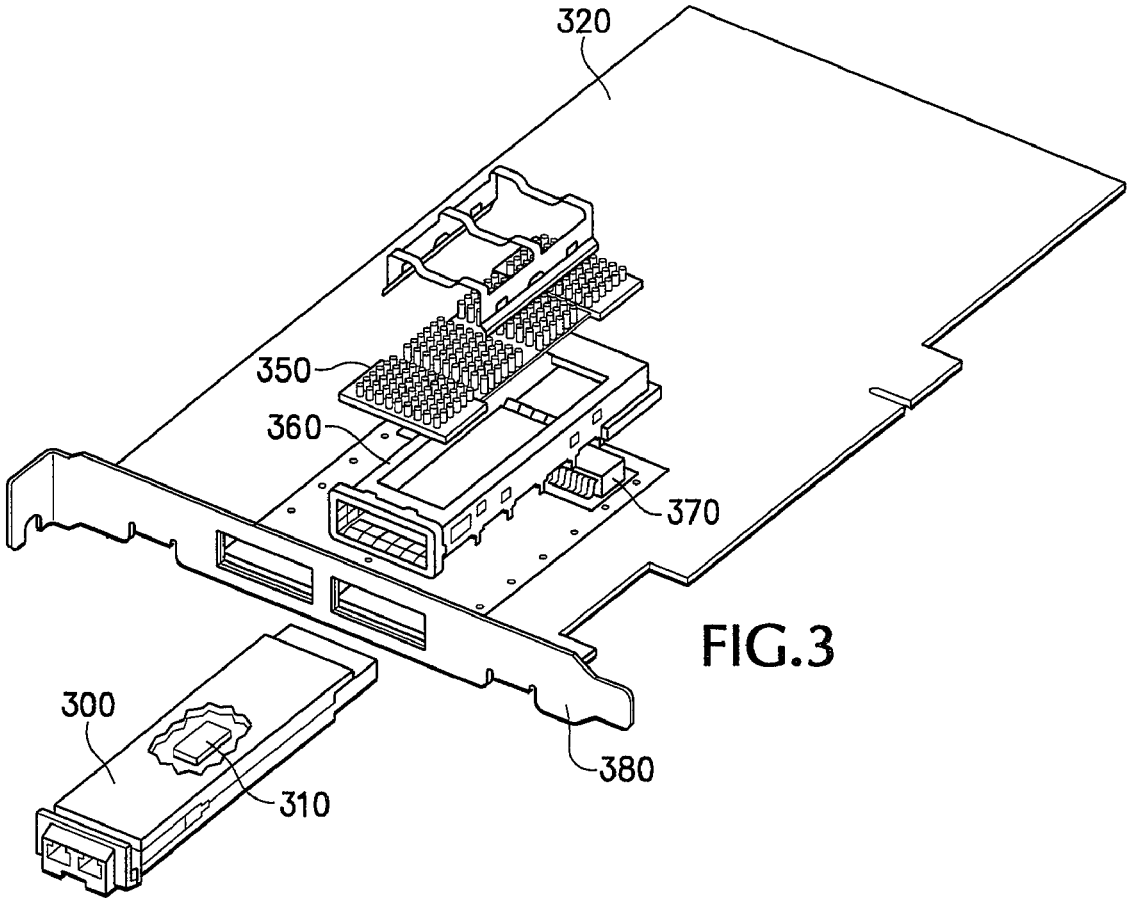
FIG. 3 is a perspective diagram of a transceiver module incorporating a temperature-controlling apparatus, according to an embodiment.

As an example of how a temperature-adjusting apparatus may be applied in an embodiment, FIG. 3 is a perspective diagram of transceiver module embodiment 300 incorporating a temperature apparatus embodiment 310. In particular, a host board embodiment 320 may comprise a printed circuit board to which a cage assembly 360 and connector 370 may be mounted. A heat sink 350 may be thermally coupled to cage assembly 360. A bezel 380 may be coupled to a front edge of host board 320 for securing host board 320 to a rack (not shown), for example. Temperature-adjusting apparatus 310 may be used to adjust temperature of components within transceiver module 300. As mentioned above, components such as avalanche photodiodes or laser diodes have output signals that may be sensitive to temperature, so an ability to adjust temperature may be beneficial.

Referring to FIG. 3, host board 320 may receive transceiver module 300 as a plug-in. Both host board 320 or transceiver module 300 may meet electrical, management, and mechanical specifications of an SFP/XFP module, for example. Module 300, conforming to industry specifications, may be subject to specific thermal constraints. Module 300 may comprise a small form-factor pluggable (SFP) module, or an XFP module, for example. It may be desirable that the temperature-adjusting apparatus 310 operate with a relatively high efficiency, for example: power may involve careful budgeting among components, among which may include a TEC, comprising module 300, for example. Of course, this is merely one example, and claimed subject matter is not limited in this respect.

FIG. 4 shows various transceiver components that may be included in a transceiver module, according to an embodiment. For example, in one embodiment, an XFP module 400 may incorporate a receiver 415 to amplify or process a signal of a detector 410, and a transmitter driver 425 to drive a light source 420. Detector 410 may include a positive-intrinsic-negative (PiN) photodiode or an avalanche photodiode (APD), for example. Light source 420 may include a light emitting diode (LED) or a laser diode (LD), for example. Receiver 415 or driver 425 may be coupled to a microcontroller 430. Microcontroller 430 may adjust functions of receiver 415 or driver 425 and may also include temperature adjustment functions. Alternatively, receiver 415 and transmitter driver 425 may include their own temperature adjustment functions 405, which may include a TEC circuit or a temperature sensor circuit such as those described for the embodiment of FIG. 1, for example.

An embodiment of a voltage converter, which may be used in a microcontroller, such as microcontroller 430 in FIG. 4, for example, is shown in FIG. 5A. In this particular embodiment, an input voltage Vin may be applied at input port or terminal 510, and an output voltage Vout is produced at output 520 by a voltage converter 515. Such a voltage converter 515 may include a high efficiency phase-width modulated (PWM) synchronous buck regulator, for example. However, this is merely an example and claimed subject matter is not limited in this respect. In an embodiment, voltage converter 515 may have, for example, greater than 95% efficiency, wherein efficiency is defined as the amount of useful output power divided by the amount of power consumed by voltage converter 515. Of course, this is merely one example, and claimed subject matter is not limited in this respect. Many other levels of efficiency are possible and are included within the scope of claimed subject matter.

Vout may be affected by a resistor divider network 530 that may comprise resistors R1 and R2. A divided voltage Vdiv may be applied to a feedback input port or terminal Fb, as in FIG. 5A. Likewise, resistor divider network 530 may be grounded at terminus 540.

Figure 6:
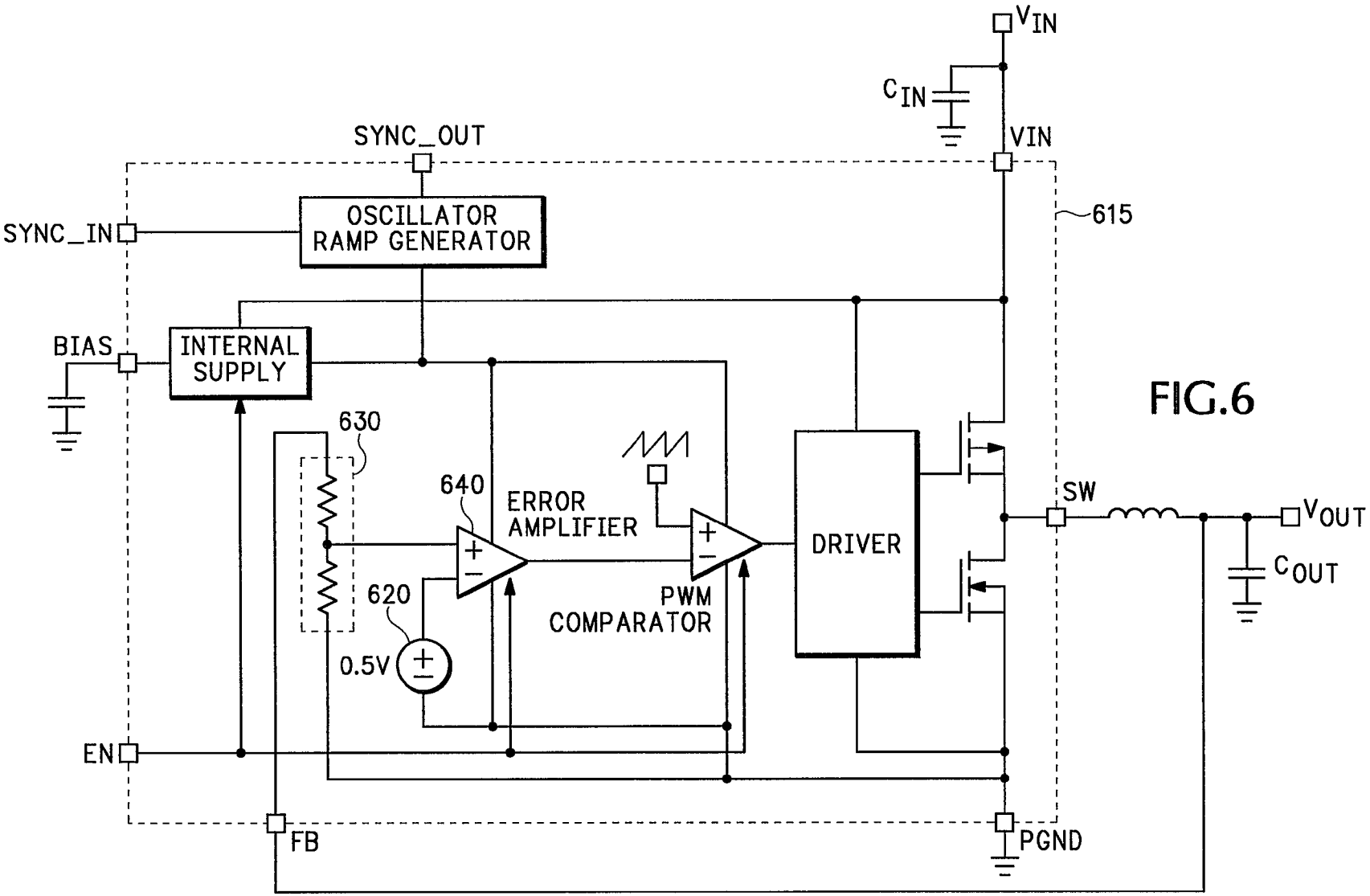
FIG. 6 is a schematic showing a pin-out of the sample voltage converter of FIGS. 5A and 5B, according to an embodiment.

FIG. 6 shows a possible pin-out or a partial view of components of a voltage converter embodiment 615, which may include voltage converter embodiment 515 in FIG. 5A. Of course, this is merely one example, and claimed subject matter is not limited in this respect. Referring to FIG. 6, Vin may provide power to the voltage converter output terminal or to a bias supply. An enable pin En may provide a logic level signal to the output terminal, wherein the voltage converter may have an off-state with a supply current of approximately zero. Input terminals Sync_in and Sync_out may provide an ability to change the switching frequency or to interconnect multiple voltage converters. A bias input signal may supply an internal biasing voltage to voltage converter 615, for example. A feedback input terminal Fb may provide a path to modify the output signal of voltage converter 615. Internal voltage divider 630 may couple the feedback input terminal Fb to the voltage converter output terminal and may be used to adjust the desired output voltage. Feedback input terminal Fb may couple internally to an error amplifier 640 that may compare the voltage level at feedback input terminal Fb to an internal 0.5 volt reference voltage 620, for example, and may adjust output voltage to substantially maintain regulation. Of course, this is merely one example, and claimed subject matter is not limited in this respect.

Referring to voltage converter embodiment 515 in FIG. 5A, for example, for a voltage divider network, a desired output signal may be determined by the relation R2=R1/[Vout/Vref−1], where Vref=0.5 volts and Vout is a desired output voltage level. Written differently, Vout=Vref [R1+R2]/R2, such a relationship may imply that Vout may be as small as Vref which, with the circuit configuration in the present particular example, is 0.5 volts. Vout may reach this value if R2 is large, or open, for example, which may lead to a voltage applied to feedback terminal Fb approximately equal to Vout. Of course, this is merely one example, and claimed subject matter is not limited in this respect.

Another embodiment, shown in FIG. 5B, may include a circuit similar to that shown in FIG. 5A, except that resistor divider network 530 may be terminated at a voltage source $V_x$ 545 instead of ground. The presence of $V_x$ 545 may result in such a voltage level applied to feedback terminal Fb as to allow Vout to approach approximately zero. $V_x$ 545 may make such an applied voltage possible by at least partially offsetting the portion of Vout that is applied to the feedback terminal Fb. Without such an offset, as in FIG. 5A, a voltage level applied to feedback terminal Fb may not be able to reach values that would allow Vout to approach zero, regardless of R1 or R2 values. In another embodiment, a voltage level less than approximately 0.5 volts may be realized. In yet another embodiment, for example, a voltage level less than approximately 0.1 volts may be realized. Therefore, claimed subject matter is not limited in scope to a particular voltage level.

As in an embodiment below, $V_x$ may be replaced by a digital to analog converter (DAC), for example, so that digital signals applied to the DAC affecting its output signal may adjust a voltage level applied to the feedback terminal Fb. This approach will be explained in detail below.

In another particular embodiment, an offset may be at least partially generated by a lookup table for temperature. Vout may change with temperature. In response to such a change, an offset may be adjusted to at least partially compensate for a temperature change. A lower offset may lead to a higher Vout, and a higher offset may lead to a lower Vout, for example.

Figure 7:
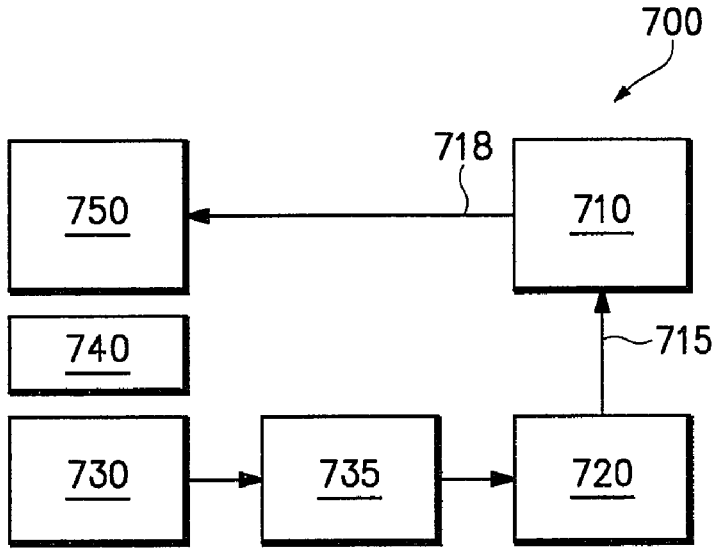
FIG. 7 is a schematic showing a configuration of a TEC system, according to an embodiment.

FIG. 7 shows a configuration of a temperature-adjusting apparatus 700 to adjust temperature of a component 740, according to an embodiment. TEC embodiment 750, thermally coupled to component 740, may heat or cool the component based, at least in part, on voltage level at an output terminal of a voltage converter 710. Temperature of component 740 may be measured by a thermistor embodiment 730, which may result in a TEC offset calculated by a microcontroller embodiment 735, for example. Such a TEC offset may be applied to a digital to analog converter (DAC) 720 to produce an analog signal, such as a voltage, resulting from the TEC offset. The analog signal may be applied to a feedback input terminal 715 of voltage converter 710 so that the superposition of the respective signals produces a voltage level at output terminal 718 of voltage converter 710. In an embodiment, the voltage level at output terminal 718 may include a voltage range down to about zero volts. In turn, this relatively low output voltage level may be applied to TEC 750 if it is operated at a relatively low drive current, as discussed above, to reduce TEC power inefficiency, for example. Of course, this is merely one example, and claimed subject matter is not limited in this respect.

Figure 8:
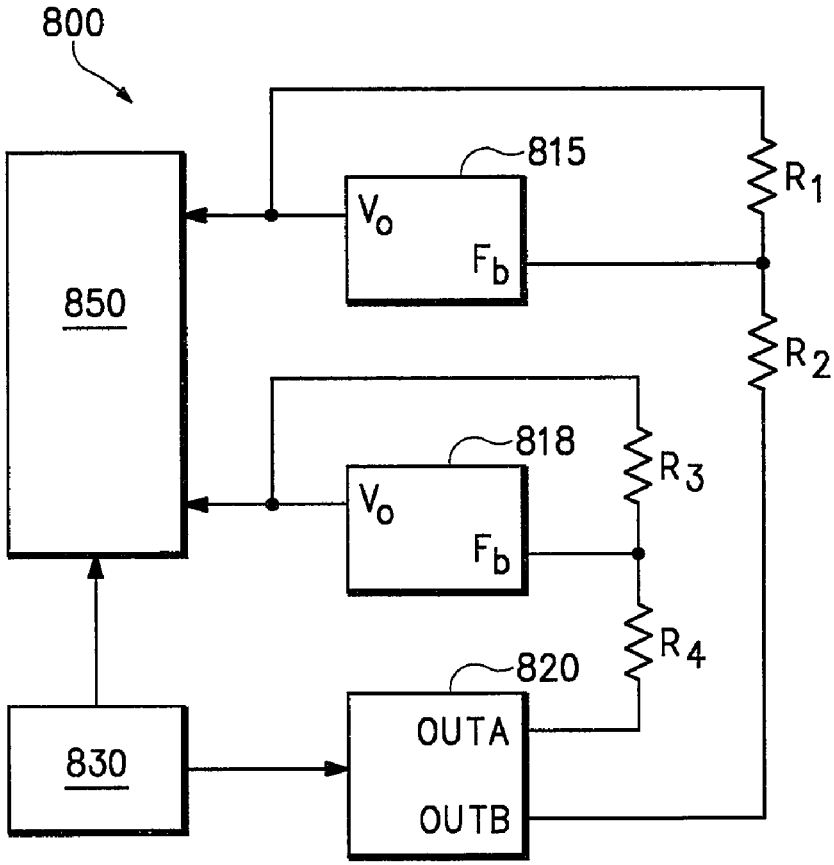
FIG. 8 is a schematic showing a sample configuration of a TEC drive circuit, according to an embodiment.

FIG. 8 shows a configuration of a TEC drive circuit 800, according to an embodiment. A first voltage converter embodiment 815 may apply a first voltage level to a terminal of TEC 850 and a second voltage converter 818 may apply a second voltage level to another terminal of TEC 850, for example. In this particular embodiment, and as indicated in FIG. 8, first and second voltage converters 815 and 818 may include an output signal Vo to drive a respective terminal of TEC 850. Output signal Vo may also be applied to a resistor divider network that may include resistors R1, R2 and R3, R4, respectively, for example. A divided voltage $V_{div}$ at nodes between the resistors may be applied to a feedback input terminal, Fb, for example.

The voltage level at output terminal Vo may at least partially be determined by a voltage at feedback input terminal, Fb. A relationship between the voltage levels at output terminal Vo and feedback input terminal Fb may be understood from the block diagram of voltage converter 615, shown in FIG. 6, which may represent first and second voltage converters 815 and 818, for example.

A digital to analog converter (DAC) 820 may produce output voltages at terminals OUTA and OUTB in response to digital signals produced by microcontroller 830. Such output voltages may combine into a superposition with respective voltages at output terminals of voltage converters 815 and 818 to produce voltages at feedback input terminal Fb of first and second voltage converters 815 and 818, for example. Voltages at feedback terminals Fb at least partially offset by a DAC may allow voltage converters 815 and 818 to produce output voltage levels applied to input terminals of TEC 850 of about zero volts, for example. Such a relatively low output voltage applied to TEC 850 operating at a relatively low drive current may reduce TEC power inefficiency, as discussed above.

Here, relatively low output voltage includes voltage levels less than approximately 0.5 volts, though, as mentioned above, relatively low output voltage may also include less than approximately 0.1 volts, or approximately zero volts in other embodiments. In any case, claimed subject matter is not limited in scope to these particular values.

Values for resistors R1, R2, R3, and R4 may be selected by considering desired voltage ranges to be applied to TEC 850, for example. Accordingly, a digital signal applied to DAC 820 by microcontroller 830 may, at least in part, relate to the voltage level at output terminals Vo applied to TEC 850. Such a voltage applied to TEC 850 may fall within a voltage range mentioned above, for example.

One skilled in the art will realize that an unlimited number of variations to the above descriptions is possible, and that the examples and the accompanying figures are merely to illustrate particular implementation(s). While there has been illustrated or described what are presently considered to be example embodiments, it will be understood by those skilled in the art that various other modifications may be made, or equivalents may be substituted, without departing from claimed subject matter. Additionally, many modifications may be made to adapt a particular situation to the teachings of claimed subject matter without departing from concepts or claimed subject matter described herein. Therefore, it is intended that claimed subject matter not be limited to particular embodiments disclosed, but that such claimed subject matter also include all embodiments falling within the scope of the appended claims, or equivalents thereof.

The invention claimed is:

1. A method of controlling a thermoelectric cooler (TEC), the method comprising:

determining a TEC offset from a plurality of TEC temperature measurements; and based at least in part on said TEC offset, applying one or more voltages to said TEC so that an operating voltage of said TEC is driven to approximately less than about 0.5 volts.

2. The method of claim 1, wherein said one or more voltages are produced by converting from a first voltage level to a second voltage level.

3. The method of claim 2, wherein said one or more voltages are produced by a DC-DC converter.

4. The method of claim 1, further comprising driving said one or more voltages at least partly in response to an analog output signal of a digital to analog converter (DAC).

5. The method of claim 1, wherein said operating voltage of said TEC is driven to approximately less than about 0.1 volts.

6. The method of claim 5, wherein said operating voltage of said TEC is driven to approximately less than about 0.05 volts.

7. The method of claim 6, wherein said operating voltage of said TEC is driven to approximately zero volts.

8. An apparatus comprising:

a thermoelectric cooler (TEC); and a controller, said controller to drive an operating voltage of said TEC to approximately less than about 0.5 volts, wherein said controller is operable to compute a TEC offset, wherein said controller is responsive to a plurality of thermistor measurements, and wherein said controller is configurable to drive said TEC via at least one of a plurality of voltage converters.

9. The apparatus of claim 8, wherein said TEC and said controller are incorporated in a pluggable form factor module.

10. The apparatus of claim 9, wherein said pluggable form factor module comprises an SFP or an XFP module.

11. The apparatus of claim 8, further comprising a digital to analog converter (DAC).

12. The apparatus of claim 8, wherein one or more analog output terminals of said DAC are coupled to said plurality of voltage converters.

13. The apparatus of claim 8, wherein said voltage converters comprise a DC-DC converter.

14. An apparatus comprising:

a thermoelectric cooler (TEC);

a thermistor;

a controller to generate a TEC temperature offset;

a first DC-DC converter to generate a first output voltage; and a second DC-DC converter to generate a second output voltage, wherein at least said first or second DC-DC converter is responsive, at least in part, to said TEC temperature offset, and is capable of driving at least said second or first output voltage to approximately less than about 0.5 volts.

15. The apparatus of claim 14, wherein said first DC-DC converter includes first converter feedback circuitry and said second DC-DC converter includes second converter feedback circuitry.

16. The apparatus of claim 15, further comprising a digital to analog converter (DAC) including a first analog output terminal coupled to said first converter feedback circuitry and a second analog output terminal coupled to said second converter feedback circuitry, wherein the first and the second analog output terminals of the DAC are responsive to said TEC temperature offset.

17. The apparatus of claim 16, wherein said first analog output terminal of said DAC is capable of providing a voltage level to said first converter feedback circuitry so that said first DC-DC converter is capable of driving said first output voltage to approximately less than about 0.5 volts.

18. An apparatus comprising:

a transceiver module incorporating a thermoelectric cooler (TEC) and a controller;

a thermistor disposed in said transceiver module; and a voltage converter including voltage converter feedback circuitry, wherein said voltage converter is capable of producing an output voltage of approximately less than about 0.5 volts.

19. The apparatus of claim 18, further comprising a digital to analog converter (DAC) including an analog output terminal coupled to said first converter feedback circuitry, wherein said analog output terminal is responsive to a TEC temperature offset.

20. The apparatus of claim 19, wherein said analog output terminal of said DAC is capable of providing a voltage level to said voltage converter feedback circuitry so that said voltage converter is capable of producing a voltage level approximately less than about 0.5 volts.

* * * * *